United States Patent [19]

Lyman

[11] Patent Number: 5,022,885

[45] Date of Patent: Jun. 11, 1991

[54] TOY CONSTRUCTION SET FEATURING RADIATING FACE AND COMPLEMENTARY EDGE CONNECTORS

[76] Inventor: Ronald L. Lyman, 11140 Squanan River Ct., Rancho Cordova, Calif. 95670

[21] Appl. No.: 419,095

[22] Filed: Oct. 10, 1989

[51] Int. Cl.[5] ..... A63H 17/00; A63H 33/04; A63H 33/06; A63H 33/08

[52] U.S. Cl. ..... 446/95; 446/117; 446/120; 446/125

[58] Field of Search ..... 446/94, 95, 96, 104, 446/108, 109, 110, 111, 115, 116, 117, 118, 120, 121, 124, 125, 126, 127, 128

[56] References Cited

U.S. PATENT DOCUMENTS

| | | | |
|---|---|---|---|
| 2,708,329 | 5/1955 | McKee | 446/108 X |
| 3,032,919 | 5/1962 | Amsler | 446/95 X |
| 3,867,784 | 2/1975 | Lange | 446/128 |
| 4,080,742 | 3/1978 | Osterried | 446/116 X |
| 4,257,207 | 3/1981 | Davis | 446/109 X |
| 4,270,303 | 6/1981 | Xanthopoulos et al. | 446/128 X |
| 4,731,041 | 3/1988 | Ziegler | 446/128 X |
| 4,792,319 | 12/1988 | Svagerko | 446/128 X |

FOREIGN PATENT DOCUMENTS

| | | | |
|---|---|---|---|
| 0900069 | 1/1989 | European Pat. Off. | 446/109 |
| 2429491 | 1/1975 | Fed. Rep. of Germany | 446/128 |
| 740951 | 11/1955 | United Kingdom | 446/127 |
| 1212537 | 11/1970 | United Kingdom | 446/125 |

*Primary Examiner*—Robert A. Hafer
*Assistant Examiner*—D. Neal Muir
*Attorney, Agent, or Firm*—Bernhard Kreten

[57] ABSTRACT

A construction toy formed from a plurality of building blocks. Each building block is formed with a multiplicity of facets defining the exterior and each facet is provided with structure for attachment to another facet. Some facets are embodied as including a plurality of radially extending vanes, others are complementally formed recesses. Preferably these recesses and vanes are disposed on top and bottom walls of a building block, defining two of the facets. A periphery circumscribes the top and bottom walls and defines a plurality of additional facets. This periphery is provided with further structure for interconnection with other facets on the block. Some peripheries are provided with projections, others with channels. The projections can be received not only in the channels, but also within recesses on the bottom walls. The channels not only can receive projections, but also can receive the vanes on the top wall of the block.

23 Claims, 10 Drawing Sheets

TOY CONSTRUCTION SET FEATURING RADIATING FACE AND COMPLEMENTARY EDGE CONNECTORS

FIELD OF THE INVENTION

The following invention relates generally to an instrumentality for creating objects of amusement formed from a plurality of blocks for children. The blocks can be interconnected so that they stimulate the child's imagination and creativity to form structures.

BACKGROUND OF THE INVENTION

The prior art is relatively rich in attempts at providing construction blocks for children which challenge the child's imagination yet are not so complex as to frustrate the child in his creative endeavors. Not surprisingly, therefore, many can be grouped into the above noted objection categories as being either too simple or too complex.

The following patents reflect the state of the art of which applicant is aware and is included hereinwith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| | | |
|---|---|---|
| FR2534-481-A | Bersani | 4/20/84 |
| EP-109-181-A | Inskip | 5/23/84 |
| BR1,167,678 | Playcraft Toys, Inc. | 10/22/69 |
| BR1,382,134 | Retzler & Knight | 1/29/75 |
| 1,405,851 | Frederick W. Lewis | 2/7/22 |
| 1,554,095 | Hultman | 9/15/25 |
| 2,776,521 | Zimmerman | 1/8/57 |
| 2,972,833 | Grutta | 2/28/61 |
| 3,005,282 | Christiansen | 10/24/61 |
| 3,162,973 | Christiansen | 12/29/64 |
| 3,242,610 | Christiansen | 3/29/66 |
| 3,496,670 | Sloop, et al | 2/24/70 |
| 3,603,025 | Heubl | 9/7/71 |
| 3,604,145 | Zimmerman | 9/14/71 |
| 3,894,354 | Crawley | 7/15/75 |
| 3,895,456 | Fabre | 7/22/75 |
| 4,090,322 | Hake | 5/23/78 |
| 4,055,019 | Harvey | 10/25/77 |
| 4,185,410 | Kristiansen | 1/29/80 |
| 4,214,403 | Knudsen | 7/29/80 |
| 4,253,268 | Mayr | 3/3/81 |
| 4,606,732 | Lyman | 8/19/86 |
| 4,764,144 | Lyman | 8/16/88 |
| 4,789,369 | Lyman | 12/6/88 |

SUMMARY OF THE INVENTION

The instant invention is distinguished over the known prior art in a plurality of ways. In general, the blocks forming the instant invention assume a substantially wafer like configuration having a top surface and a bottom surface. The top surface is effectively the compliment of the bottom surface and visa versa. That is, each surface is formed with a series of projections and recesses. The recesses on one surface define the projections on the other surface. In this manner, all similar blocks thus formed are capable of being stacked and locked one on top of the other.

In practice, the projections and associated recesses defining the top and bottom surfaces are oriented such that a plurality of radially extending vanes are provided on one surface and the complemental recesses on the opposite surface are provided between a plurality of radially extending wedges. Because of this symmetry, each block has a "radiance" when viewing the top and bottom surfaces of the wafer shaped building block. By "radiance" it is meant to connote a center having radially diverging lines.

Besides the top and bottom surfaces being inverse images of one another, each wafer-shaped building block includes a peripheral side wall circumscribing the block provided with a further means for interconnecting adjacent blocks. The interconnection means generally embraces one of two forms: either a projection or a channel. Blocks having a peripheral wall that includes the circumscribing channel can therefore be connected with those blocks having circumscribing projections by insertion of the projection into the channel. This channel can also connect with the vanes on the block's top surface because the vanes and the projections have the same thickness. Building blocks having a peripheral projection can also connect between the wedges formed on the surface of the block which defines the recesses. Alternatively stated, the blocks can be interconnected by stacking the surfaces, by placing an appropriate edge of the block on a surface, or by connecting edges.

Because of the radiating pattern of the vanes and the associated wedges, orientation of the blocks for interconnection is relatively neutral. Thus, two surfaces can be interconnected in such a manner that incremental rotation of under and overlying blocks is possible so long as the rotational increment equals 360/2N degrees. N equals the number of sides on a block. Thus, where N equals 4, rotation of a block 45 degrees will allow it to be connected to its counterpart without difficulty. Similarly, because the peripheral sidewall is dimensioned such that its channel (or projection) on the peripheral sidewall corresponds to the thickness of the vane (or recess), it too can be rotated when its edge is connected to a top or bottom block surface.

In addition, because the radially directed vanes and complementally formed recesses occur along an axis of symmetry on the top and bottom surfaces, the blocks can be interconnected only on sectors of the block. This means that over and underlying blocks can be terraced, forming imbrications or further tying blocks together via overlap. This allows adjacent blocks to be further interconnected so that one block can interconnect with plural adjacent blocks. Where N equal 4, the sectors are quadrants.

Moreover, the phenomena of overlap can also be utilized to advantage with respect to the side wall channels and projections. These can overlap other sidewalls, vanes and recesses as will be developed.

Succinctly stated, the instant invention spans the spectrum of complexity from a most simple toy to a most demanding, complex and creative toy to accommodate the interest pattern and skill level of the widest cross section of children and adults. The blocks themselves are capable of interconnection on all surfaces and also capable of overlapping with adjacent blocks in a large number of patterns. The blocks themselves are also both optically ornate and of complex contour to provide both visual and tactile stimulus.

OBJECTS OF THE INVENTION

Accordingly, it is a primary object of the present invention to provide a novel and useful construction toy set.

A further object of the present invention is to provide a device as characterized above which is extremely simple to use thereby appealing to users having a modest skill level but also capable of manipulation by extremely creative people thereby spanning a broad spectrum in maintaining interest of users.

A further object of the present invention is to provide a device as characterized above which is both visually and tactilely stimulating.

It is yet a further object of the present invention is to provide a device as characterized above which is extremely durable in construction, safe to use and lends itself to mass production techniques.

A further object of the present invention is to provide a device as characterized above which is dimensioned such that even young children can safely play with blocks forming the construction toy set.

A further object of the present invention is to provide a device as characterized above where blocks can be interconnected in a multiplicity of ways, thereby promulgating creativity and providing an extremely large number of possible structures buildable with this construction set.

Viewed from one vantage point, it is an object of the present invention to provide a device of the character described above in which a building block is provided with a top wall, a bottom wall and a periphery between the bottom and the top walls, the top wall defines a first attachment surface and the bottom wall defines a second attachment surface. The first and second attachment surfaces collectively define complemental, interconnecting contours and the periphery provided between the top and bottom walls defines a third attachment surface.

Viewed from a second vantage point, it is an object of the present invention to provide a device of the character described above wherein a wafer shaped toy is provided which includes a top wall formed with a plurality of radially extending vanes, a bottom wall including a plurality of radially extending recesses dimensioned to receive the vanes therewithin, and a peripheral edge extending between the top and bottom walls provided with means for linking the edge to another wafer-shaped toy.

A further object of the present invention, when viewed from a third vantage point, is to provide a toy construction set formed from plural elements which each include a plurality of facets defining an exterior of a first element and means on each said facet for connecting said first element to a second element, said second element having multiple facets defining an exterior and provided with uniting means to receive said connecting means, whereby said uniting and connecting means allow first and second elements to be linked.

A further object, when viewed from a fourth vantage point is to provide a plurality of accessories connectable to the above described invention for further, enhanced effects. Some accessories are also interconnectable.

These and other objects will be made manifest when considering the following detailed specification when taken in conjunction with the appended drawing figures.

DESCRIPTION OF THE DRAWING FIGURES

FIGS. 27–29 operate as a wheel for the apparatus.

BRIEF DESCRIPTION OF THE PREFERRED EMBODIMENTS

Figure 1:
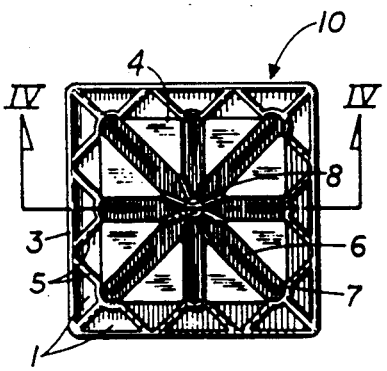
FIG. 1 is a top plan view of the apparatus according to one form of the invention.

Referring to the drawing now, wherein like reference numerals refer to like parts throughout the various drawing figures, reference numeral 10 as shown in FIGS. 1 through 5 is directed to one form of building block.

As shown in these drawings, the element 10 defines a first building block which has plural facets. In its essence, the element 10 includes a top wall 2 which provides a first attachment surface and associated connecting means. Bottom wall 12 provides a second attachment surface with uniting means. A peripheral, channel 20 defines a third attachment area. Note that walls 2 and 12 have a substantially square profile. Thus, the first building element is polygonal and has N sides, where N equals 4.

The top wall 2 is formed with a plurality of wedges 4 which are configured as right triangles oriented such that each right triangle has a hypoteneuse which faces along a diagonal of the block. Thus, there are 2N wedges for a total of 8.

A plurality of spaces 6 extend radially between adjacent wedges 4. These radially extending spaces 6 include deeper recesses 7 and describe the vanes 16 on the opposite side 12 of the block shown in FIG. 3. 2N spaces are provided which in this example provide a total of 8 spaces.

A central hub 8 is provided with a plurality of radially extending spokes which extend to and are aligned with apices of the wedges 4. As shown, 2N spokes are provided for a total of 8, since N equals 4.

The top surface 2 is circumscribed by a peripheral shelf 1 which includes an upwardly extending peripheral lip 3. As shown, a lattice 5 extends upwardly from the shelf 1 and of the same dimension or height as the peripheral lip 3. The lattice imparts strength and rigidity to the block without creating undue thickness. This reduces cycle time when molding these blocks, which preferably are made of plastic. Note that the lattice 5 includes arcuate portions where the lattice abuts against spaces 6 at their extremities.

Figure 3:
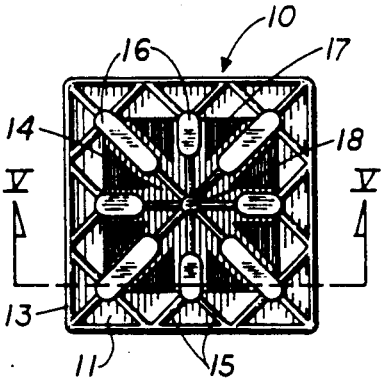
FIG. 3 is a bottom plan view of that which is shown in FIGS. 1 and 2.
Figure 4:
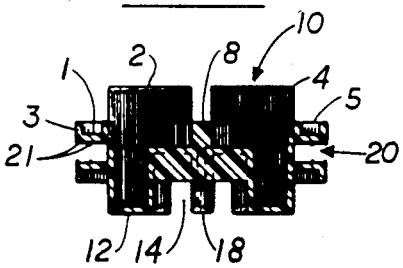
FIG. 4 is a sectional view taken along lines 4—4 of FIG. 1.
Figure 5:
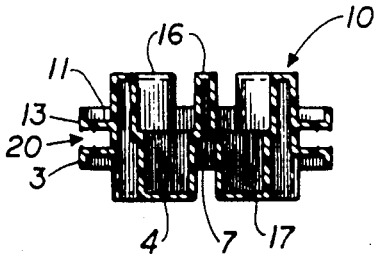
FIG. 5 is a sectional view taken along lines 5—5 of FIG. 3.
Figure 6:
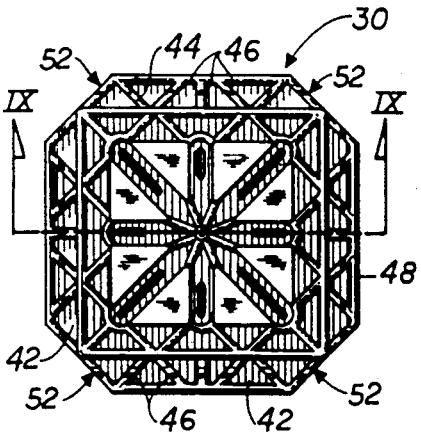
FIG. 6 depicts a second building block according to the present invention.
Figure 7:
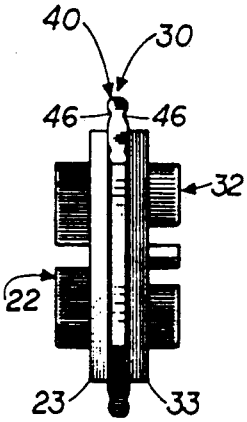
FIG. 7 is a side view of that which is shown in FIG. 6.
Figure 8:
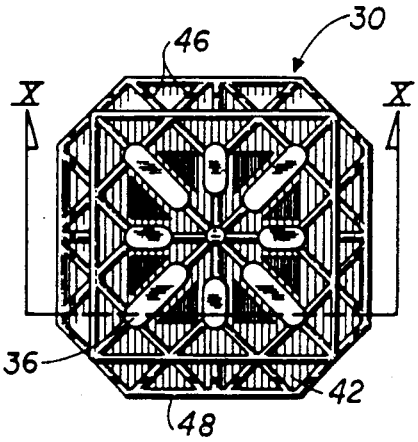
FIG. 8 is a bottom plan view of that which is shown in FIG. 6.
Figure 9:
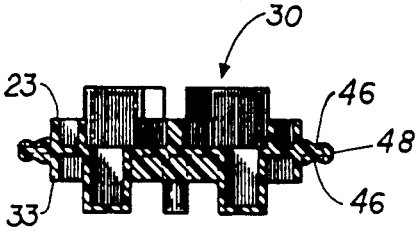
FIG. 9 is a sectional view taken along lines 9—9 of FIG. 6.
Figure 10:
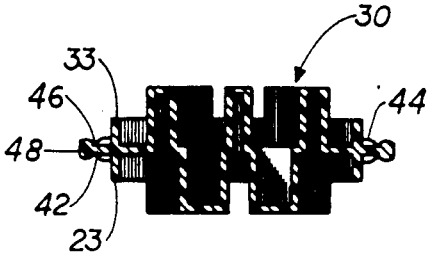
FIG. 10 is a sectional view taken along lines 10—10 of FIG. 8.

FIG. 3 reflects details of the bottom wall 12 which defines the second attachment surface. Like the top wall 2, the bottom wall 12 has a peripheral shelf 11 circumscribed by a peripherally upwardly extending lip 13. Ribbing 15 is the counterpart of the lattice work 5 on the other surface. A plurality of vanes 16 extend radially from a central hub portion 18 of the bottom wall 12. These vanes 16 emanate from the hub 18 that include a plurality of spokes which are aligned with the vanes 16. As shown, each of the vanes 16 are separated by spaces 14 which are triangularly shaped. The spaces 14 correspond to the wedges 4 on the other side of the block. The spaces 14 overlie deeper recesses 17 which form the actual interior hollow of the wedge's interior on the opposite side. As shown, there are 2N vanes in this version, where N equals 4.

Figure 2:
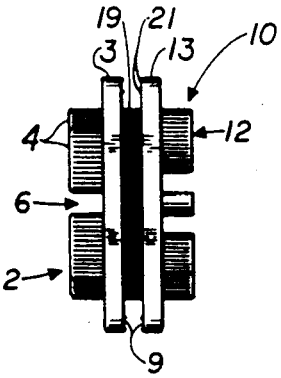
FIG. 2 is a side view thereof.

Attention is now directed to FIG. 2 which reflects certain details of the third attachment area defined by the periphery of the top wall 2 and the bottom wall 12. The third attachment surface area includes a channel 20 formed circumferentially around the building element 10, medially disposed between the top wall and the bottom wall. In essence, the channel 20 is formed from a band 19 circumscribing the building element 10 and formed on outside surfaces of the spaces 6, 14 and recesses 7,17 of the top wall 2 and bottom wall 12. The band 19 has a plurality of sides, equal to the number N of sides forming the building element. As depicted, N equals 4. The channel 20 includes not only the band 19, but also shelves 9 which are defined by bottom surfaces of the shelf 1 (of the top wall) and shelf 11 (from the bottom wall). Thus, in section a substantially U shaped channel is provided where the shelves 9 form the legs of the U shaped channel, and the band 19 serves as the bight portion. Collectively, the channel 20 as it circumscribes the first building element 10 define a third attachment surface which mates with a projection 40 on a second building element 30 to be discussed. Raised beads 21 are formed on each shelf 9 to coact with a trough 46 described infra. Each shelf 9 has two beads, with one bead concentric to the other. One bead from each shelf defines a pair and are aligned equidistant to the center of the block.

As shown in FIGS. 6 through 10, the second building element 30 conforms in all respects to the first element 10 shown in FIGS. 1 through 5, except for the details associated with the third attachment surface 20 of the first element 10. Thus, the discussion with respect to FIGS. 6 through 10 will focus on the projection 40 which defines a complemental attachment surface for the channel 20 of the first element.

The projection 40 and its associated structure causes the second building element 30 to have a configuration somewhat different from the first building element. As noted, the projection 40 includes lips 42 extending laterally from all four sides of the second building element, medially disposed between its top wall 22 and bottom wall 32. The lip 42 projects outwardly and finds support from a plurality of ribs 44 extending upwardly from the lip on both top and bottom lip surfaces. The ribs 44 provide strength to the lip, retard unwanted flexing and also minimize material to reduce curing time in the mold.

A flange 48 extends perpendicular to the lip 42, circumscribing the lip around all sides of the second building element 30. Had the projection 40 paralleled the contour of the second building element 30, the projection 40 would have had N sides, or as shown, where N equals 4, a quadrilateral. However, corners of the lip 42 and flange 48 have been truncated to provide a 2N structure, in this case an octagonal.

The truncations 52 allow adjacent blocks to be placed in tangential registry such that the lips 3, 13 of the first building element 10 and the lips 23, 33 of the second building element 30 can be placed in abutting relationship even at the corners. Stated alternatively, when four building elements are arranged in a 2×2 array, such that two building elements 30 and two building elements 10 are connected, the truncations 52 allow clearance for the 2×2 array to be interconnected. See the 2×2 array shown in FIG. 11, depicted as "R".

Notice the presence of trough 46. The trough 46 is present on both the top side of the lip 42 and its bottom side. The trough 46 passes not only through the ribs 44, but also through the truncated wall 52 defining a portion of the flange 48. Collectively, the flange 48, the portion of the ribs 44 extending between the flange 48 and the trough 46 define a somewhat bulbous portion which provides one possible first degree of attachment with the channel 20 of FIGS. 1 through 5.

When the projection 40 is inserted within the channel 20 up to an area where the trough 46 is just occluded by the lips 3, 13 extending around the periphery of the building element 10, a form of hinge is provided allowing rotation between the blocks around the direction of the arrow A. See FIG. 11. This hinge effect can be enhanced by having bead 21 emanate from the surfaces 9 of the channel 20. When inserting the second building element 30 into the first building element 10, a "snap feel" (auditory-vibratory feedback) is provided by having a first bead 21 nest within trough 46. Further penetration of the projection 40 into the channel way recess 20 provides a rigid interconnection via the second inner bead 21 contacting the trough 46.

Figure 11:
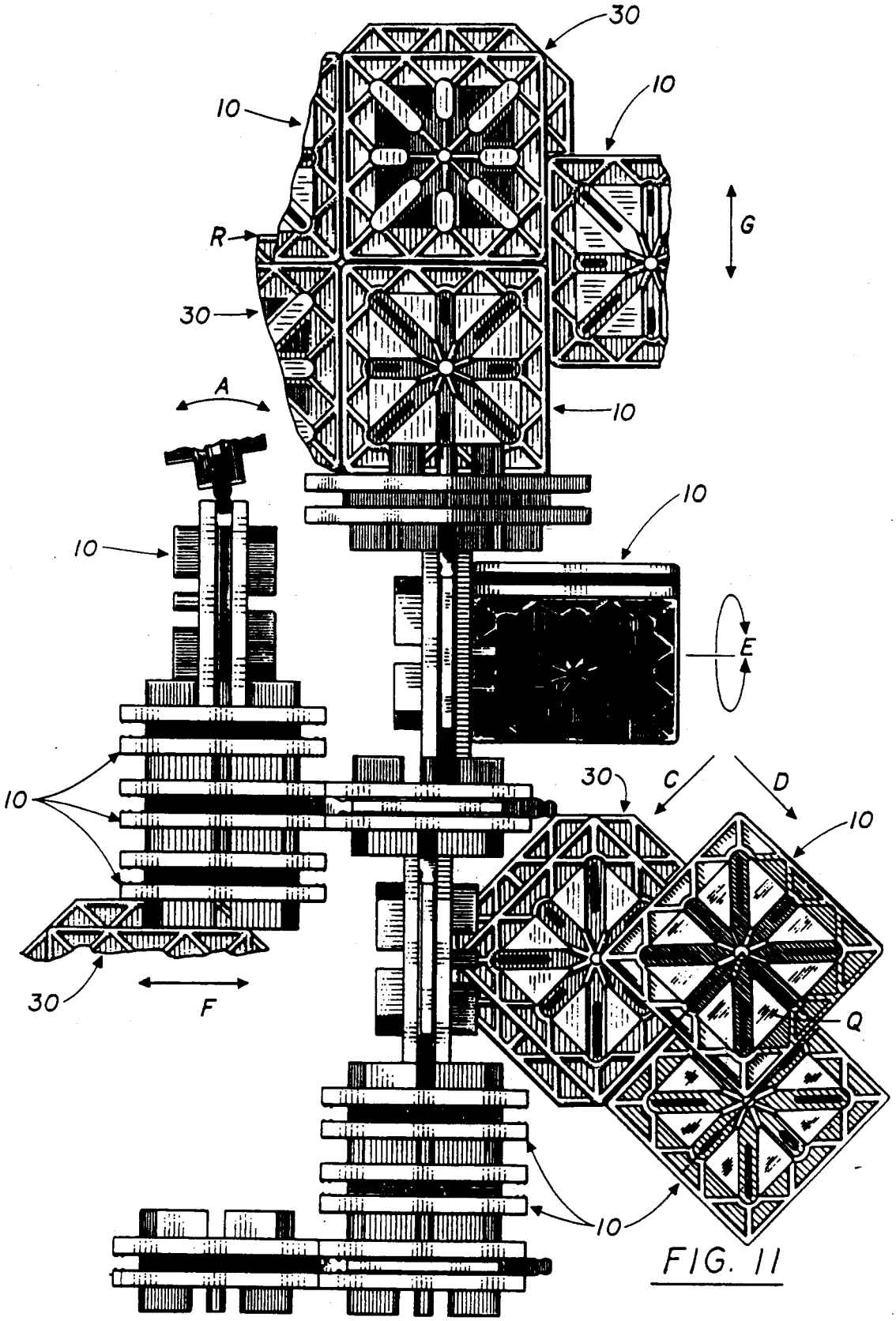
FIG. 11 is a perspective view of a plurality of the blocks shown in FIGS. 1 through 10 assembled in a certain manner to show the flexibility and adaptability of various blocks to form and to connect with different adjacent blocks.

In use and operation, the blocks described can be oriented in a multiplicity of ways, some of which have been shown for illustrative purposes in FIG. 11. It should be noted that with the configuration as described, the width of the vanes 16, 36 and the recesses 6 are complemental to the dimension of the channel 20 and the projections 40. This means that edges of the blocks can be supported on the vanes and recesses of the top and bottom surfaces. Thus, these two blocks allow attachment along the sides of adjacent blocks, between one side and a wall of the block and between walls themselves.

Notice also that the blocks are relatively neutral with respect to their ability for overlapping interconnection along arrows "C" and "D". Thus, one quadrant Q (FIG. 11) of one block can overlap with a quadrant of another block thereby providing a "tie" and imbrications.

In addition, the structure of the blocks is neutral with respect to rotational orientation as about arrow "E" of FIG. 11. Thus, since the vanes (or recesses) radiate from a central portion of each block, a side edge of one block can connect with the vane (or recess) and be reliably connected along any of the radially emanating vanes (or recesses).

Furthermore, the edges can translate along the direction F when connected to a wall of a block. Arrow G shows block translation along an edge of two blocks.

Figure 12:
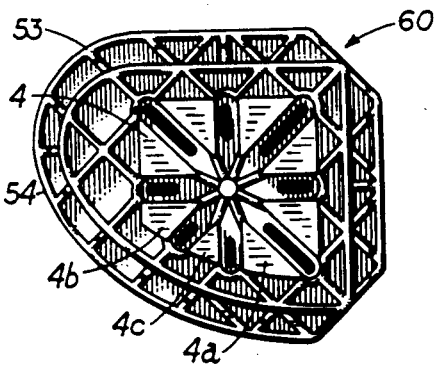
FIG. 12 is a top plan view of a third form of block.
Figure 13:
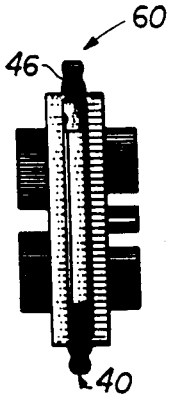
FIG. 13 is a side view of that which is shown in FIG. 12.
Figure 14:
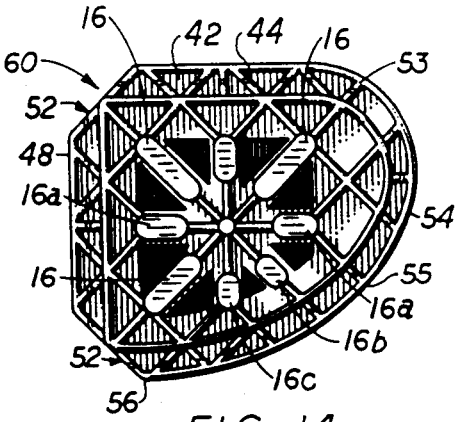
FIG. 14 is a bottom plan view of that which is shown in FIGS. 12 and 13.

FIGS. 12 through 14 reflect a further variation of that which has been delineated herein above. More particularly, and with respect to the salient differences, third building element 60 shares greates similarity with the second building element 30 except that whereas the second building element was a four sided polygon, this third building element 60 has two linear sides, similar to the second building element but these two linear sides are interconnected by an arcuate third side. Thus, the third building element is somewhat triangular in shape, but the "hypoteneuse" portion is curved as is one of the apices forming an acute angle of the modified triangle.

More specifically, reference numerals 53 and 55 correspond to what heretofor would have been corners, particularly when considering the FIG. 6–10 embodiment. Thus, these points designate arcs on a curve rather than corners. The transition from 53 to 54 on the outer periphery of the third building element 60 reflects a substantially constant radius curve that extends from what heretofore had been a diagonal through an arc of 45 degrees. From point 54 through 55 and 56, the radius of curvature changes so that from point 54 through 55 and on to 56, a generally parabolic curve conforming to the equation $Y=X^2$ will define the curve. Y defines translation vertically (i.e. up and down the paper) and X denotes translation horizontally. Note that the projection 40 circumscribes the third building element 60 as it did in the second building element. Note the presence of truncations 52 as in the second building element, and for similar purposes.

Because the contour of this third building block has been altered when compared with the second building block structure, vanes not on the diagonal (**16*a*) as well as vanes on the diagonal 16 will be affected thereby. Note that in FIG. 14, one of the diagonal vanes, labeled 16*b* has been abbreviated, while a corresponding non-diagonal vane 16*c* has been similarly shortened to accommodate the curvature associated with this third block. Similarly, and with respect to FIG. 12, the triangular wedges 4*a*, 4*b* and 4*c* have been similarly modified to accommodate the curvature along the one wall. Note this version also has a "male" projection 40**.

Figure 15:
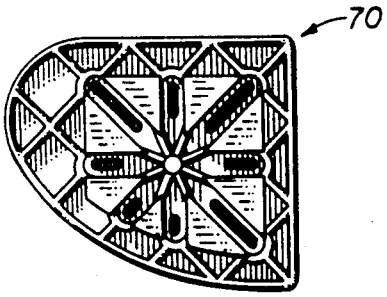
FIG. 15 shows a top plan view of another embodiment.
Figure 16:
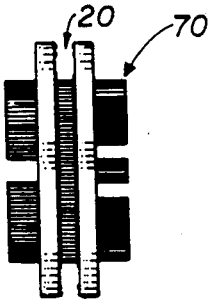
FIG. 16 is a side view of that which is shown in FIG. 15.
Figure 17:
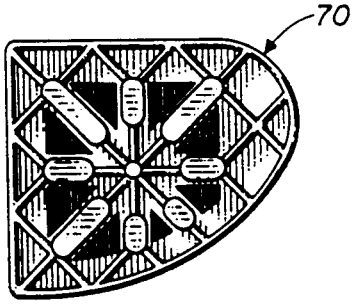
FIG. 17 is a bottom view of that which is shown in FIGS. 15 and 16.

FIGS. 15 through 17 reflect a fourth building block, similar to the third building block, but this fourth building block 70 is provided with a comparable recess 20 to that which is shown in FIGS. 1 through 5. Thus, FIGS. 15 through 17 define the "female" counterpart to the "male version" shown in FIGS. 12–14. They are thereofre geometrically similar.

Figure 18:
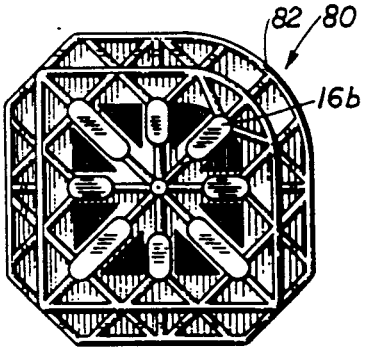
FIG. 18 depicts another embodiment of block.
Figure 19:
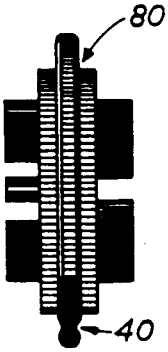
FIG. 19 is a side view of FIG. 18.
Figure 20:
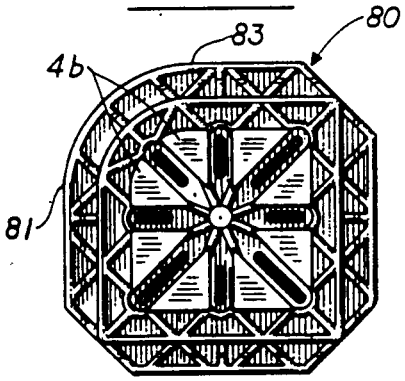
FIG. 20 is a bottom view of that which is shown in FIG. 18.

FIGS. 18 through 20 depict a fifth building block 80 which is "male" in that it has a projection 40, but differs from the third building block 60 in that this fifth building block 80 has one of its four corners provided with a constant radius curvature. As shown, the constant radius curvature 82 extends through one quadrant of the polygon. In order to accommodate this modification, only one diagonal vane **16*b* has been abbreviated, when compared to that which is shown in FIG. 12 for example or FIG. 8. Similarly, the wedges 4*b* adjacent this one corner have also been abbreviated. Thus, for this one quadrant a constant radius curve is provided between points 81 and 83** of this corner.

Figure 21:
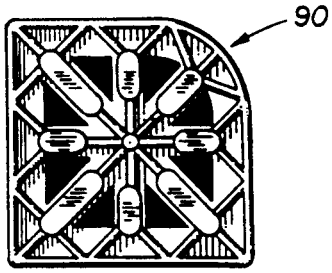
FIG. 21 is a top plan view of further form of block.
Figure 22:
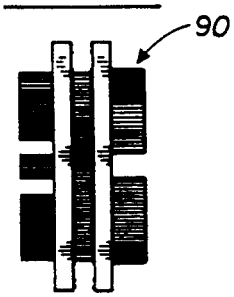
FIG. 22 is a side view of that which is shown in FIG. 21.
Figure 23:
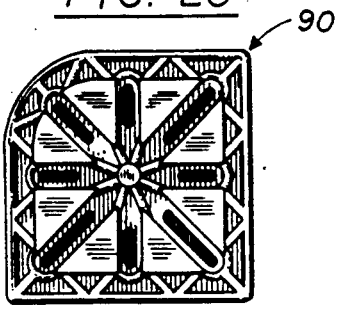
FIG. 23 is the bottom view of FIG. 21.

FIGS. 21 through 23 depict the "female" counterpart 90 defining a sixth building element.

The modified blocks shown in FIGS. 12 through 23 still retain fidelity with the initial premise of the blocks shown in FIGS. 1 through 11 in that a toy has been defined having a plurality of facets with a first attachment surface on a top area, a second attachment surface on a bottom area, and a periphery has been provided with a third attachment area. The versions of "accessories" shown in the remaining figures are intended to enhance the blocks heretofore described and are intended to compliment the previously discussed blocks.

Figure 24:
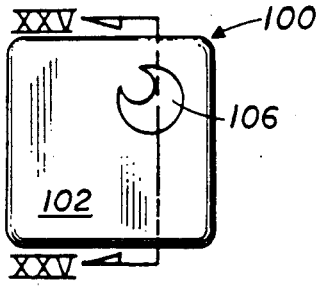
FIG. 24 is a top plan view of a boot type accessory for use with the previously described blocks.
Figure 25:
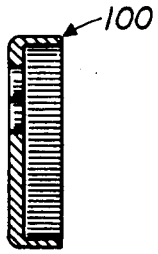
FIG. 25 is a sectional view taken along 25—25 of FIG. 24.
Figure 26:
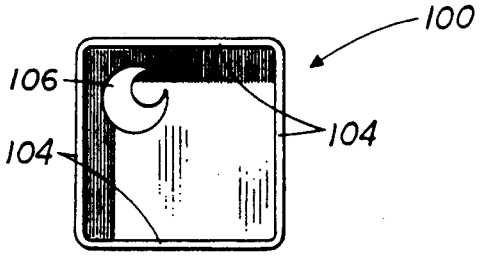
FIG. 26 is a bottom view from that which is shown in FIG. 24.
Figure 27:
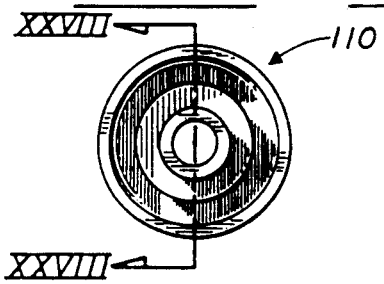
FIG. 27 is a plan view of a further form of block.
Figure 28:
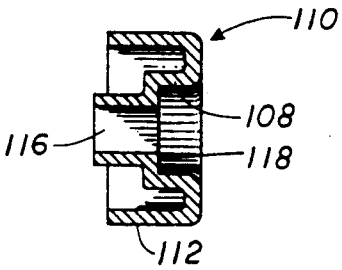
FIG. 28 is a sectional view taken along lines 28—28 of FIG. 27.
Figure 29:
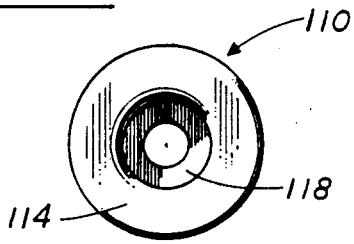
FIG. 29 is an opposite from that which is shown in FIG. 27.
Figure 30:
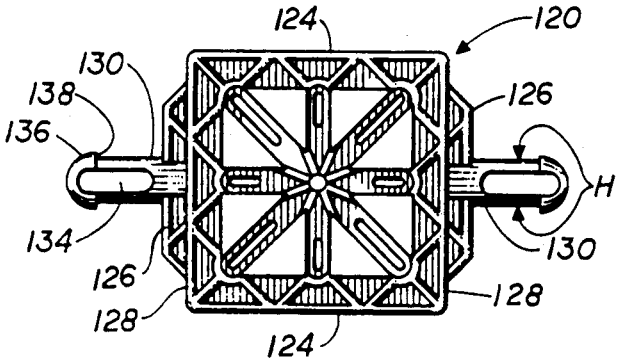
FIG. 30 is a top plan view of an axle for supporting the wheel shown in FIGS. 27–29.
Figure 31:
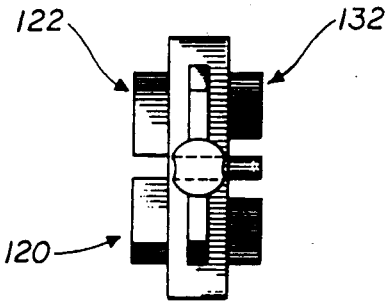
FIG. 31 is a side view of that which is shown in FIG. 30.
Figure 32:
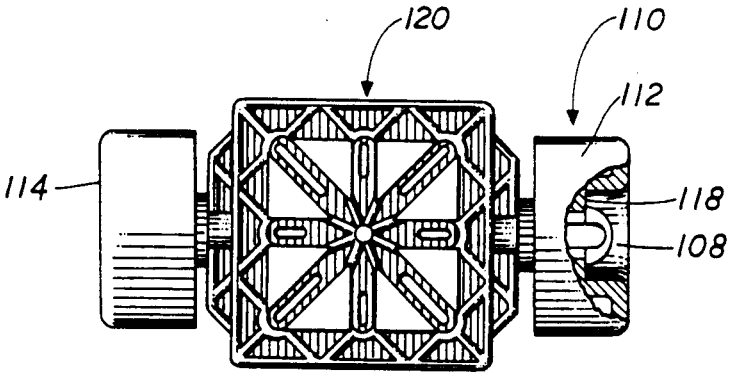
FIG. 32 shows the wheel of FIGS. 27–29 deployed on the block of FIGS. 30–31.

More specifically, FIGS. 24 through 26 detail an attachment surface occluding means, configured as a cover 100. In essence, the cover 100 includes a top wall 102 of substantially square configuration having a peripherally extending side wall 104 circumscribing the top wall 102. This cover is dimensioned to register over either the vanes 16 or the wedges 4 by having the side walls 104 frictionally engage the outer periphery of the vanes or wedges. Note the presence of a crescent shaped opening 106 oriented such that the crescent is disposed in one quadrant of the cover. When judiciously applied over a building block, this cover would be simulative of an eye. Note that this cover is dimensioned to work on all of the blocks defined hereinabove, including the third through sixth styles of blocks which have arcuate outer contours. This is made possible by the cover engaging and being retained on the linear side walls of the wedges or ends of the vanes. Thus, gaps between side walls of the cover 100 and the abbreviated version of vanes or wedges on the third through sixth building elements are not critical.

With respect to FIGS. 27 through 32, structure is delineated for providing a wheeled undercarriage for certain possible constructions of the toy. In its essence, a block 120, having an axle 130 extending out of two side walls 128 thereof support a pair of wheels 110 thereon. The block 120 has a top surface 122 provided with a plurality of wedges similar to the wedges delineated in the first through sixth building blocks, and an opposite side 132 with a plurality of radially extending vanes also similar to the previously discussed embodiments. Thus, this block 120 can connect on top and bottom surfaces with other blocks. The block 120 is substantially square having the side walls 128 which support the axles 130. For requisite structural rigidity, the axle is embedded within a built up area 126 extending between the side walls 128 and the axle 130. Note axle supporting side walls 124 have a smooth outer contour and therefore do not provide any attachment surface as had been provided with previously discussed building blocks.

The axle 130 is provided with a central longitudinally extending slit 134 and a bulbous end 136 provided with a radially extending shelf 138 between the axle shaft 130 and the bulbous end. Its function, when considered in combination with the wheels 110 will make the bulbous end 136, its notch 138 and axle 130 evident.

The wheel 110 includes an outer surface 112 of substantially annular configuration to provide rolling contact on a support surface (not shown). A disc shaped outer wall 114 provides the simulated wheel configuration, and a wheel well 118 is recessed within the disc outer wall 114 by virtue of an inwardly directed band 108 extending from the disc 114 to the well 118. The well 118 serves as a step which in turn communicates with a sleeve 116 having an inner diameter dimensioned somewhat similar to the outer diameter of the axle 130.

In order to install the wheel 110 on the axle 130, the shaft 130 must be compressed along the direction of the double ended arrow H, provided by the opening 134 on the shaft 130. Thus, the shaft 130 deforms by collapsing inwardly to be placed within the sleeve 116. The bulbous end 136 of the shaft 130 forces the collapsing of the axle 130 as described. However, once the bulbous end 136 passes beyond the sleeve 116, the shaft 130 expands and retains its initial configuration, firmly residing within the sleeve 116 and allowing rotation of the wheel 110 about the axle 130. The abutment 138 assures that the wheel will remain fixed. Given this structure, the wheels are not removable.

Figure 33:
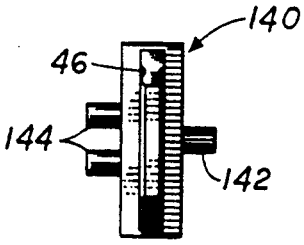
FIG. 33 is a side view of a further form of block.
Figure 34:
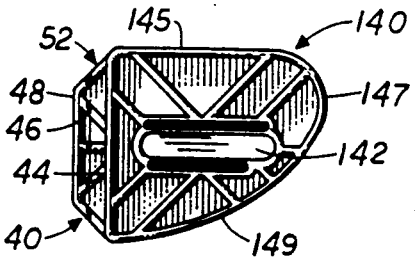
FIG. 34 is a plan view thereof.
Figure 35:
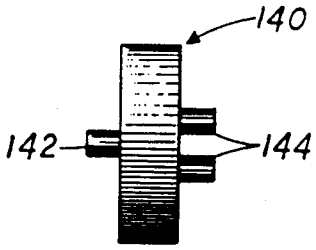
FIG. 35 is an opposite side view of that which is shown in FIGS. 33, 34.
Figure 36:
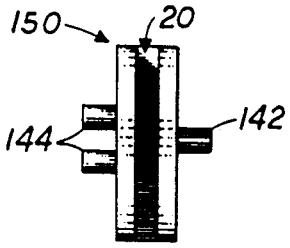
FIG. 36 is a side view of another form of block.
Figure 37:
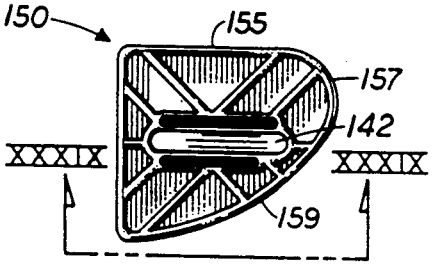
FIG. 37 is a plan view of that which is shown in FIG. 36.
Figure 38:
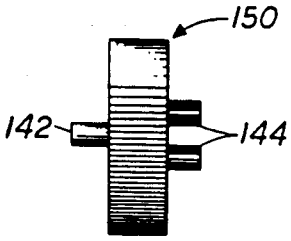
FIG. 38 is an opposite side view of that which is shown in FIGS. 36, 37.
Figure 39:
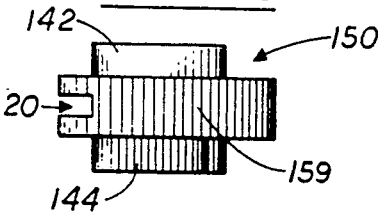
FIG. 39 is an end view taken along lines 39—39 of FIG. 37.
Figure 40:
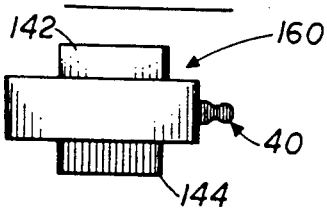
FIG. 40 is a side view of a further form of block.
Figure 41:
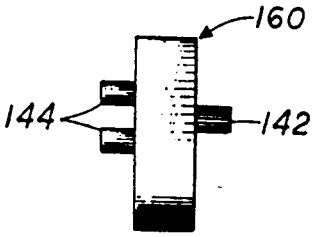
FIG. 41 is another side view of that which is shown in FIG. 40.
Figure 42:
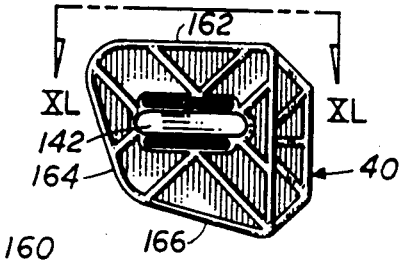
FIG. 42 is a plan view of that which is shown in FIGS. 40 and 41.
Figure 43:
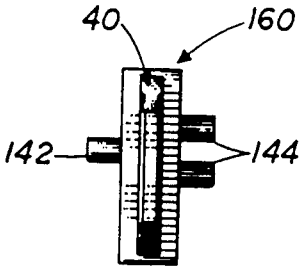
FIG. 43 is an opposite side view of that which is shown in FIGS. 40 and 41.

With respect to FIGS. 33 through 35, another form of accessory, a parabolic block 140 is show In essence, this block 140 includes a linear top wall 145, a side wall 40 having a projection extending outwardly therefrom, not dissimilar from the projection 40 shown in FIGS. 6 through 10, wherein the projection 40 includes a trough 46, ribs 44 and a peripheral end wall 48 provided with truncations 52, and a parabolic end wall. The end wall includes an area of constant radius curvature 147 and the curved portion 149 which corresponds to the equation $y=x^2$. This accessory block 140 has a top wall and a bottom wall. The top wall includes a horizontally extending vane 142 having the same thickness as the vanes 16 of the previous embodiments. Thus, this vane 142 can be placed within and attached to either a channel 20 or within recesses 14 provided between wedges 4. The opposite side of the attachment block 140 includes a pair of spaced parallel vanes 144. These vanes are spaced sufficiently to receive a projection 40 therewithin. In addition, these spaced parallel vanes 144 have the requisite thickness to frictionally receive therewithin other vanes 16.

With respect to FIGS. 36 through 39, the "female" counterpart of the FIGS. 33–35 embodiment is provided. Thus, this second attachment block 150 includes top and bottom walls having a single vane 142 on one wall and a double vane 144 on an opposite wall, similar to the FIGS. 33–35 embodiment. Rather than the projection 40, that edge is provided with a channel 20 which can receive therewithin either a vane 16 or a projection 40. The remaining side walls include a smooth linear top-side wall 155 and smooth arcuate end wall 157 and a further smooth arcuate end wall 159 having similar slope as the previous embodiment. Thus, the arcuate side walls 157 and 159 correspond to the equation $y=x^2$.

With respect to FIGS. 40 through 43, another form of accessory block 160 is shown, a "male" block with projection 40 on one side wall. In addition, the vanes 142 and 144 are on opposed top and bottom walls for similar purposes set forth with respect to the first attachment block. However, this block is somewhat trapazordal in configuration having one long wall 162 and opposed wall 166 canted towards the one long wall, and an interconnecting truncated wall 164. This block 160 may be described as a "nose" piece which has particular utility when creating elements simulative of vehicles.

Figure 44:
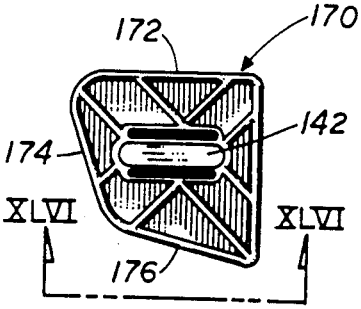
FIG. 44 is a top plan view of a further form of block.
Figure 45:
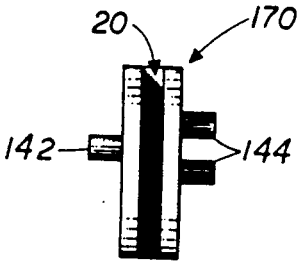
FIG. 45 is a side view taken along lines 45—45 of FIG. 44.
Figure 46:
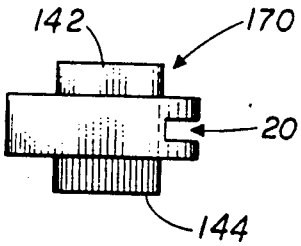
FIG. 46 is an alternate side view.

FIGS. 44 through 46 reflect the "female" counterpart to the last described block. It too has one long wall 172, a wall 76 canted towards said long wall on an opposite side, this canted 176 declinated towards the long wall and a truncated wall 174 interconnecting the top and bottom walls. The channel 20 allows connection of this block with other blocks.

The remaining drawing figures reflect the utilization of these various blocks in different configurations illustrating their ability to simulate other objects. These orientations are merely illustrative and are not intended to be limiting. The reference resembles are directed generally to the blocks that constitute some of the possible combinations.

Figure 47:
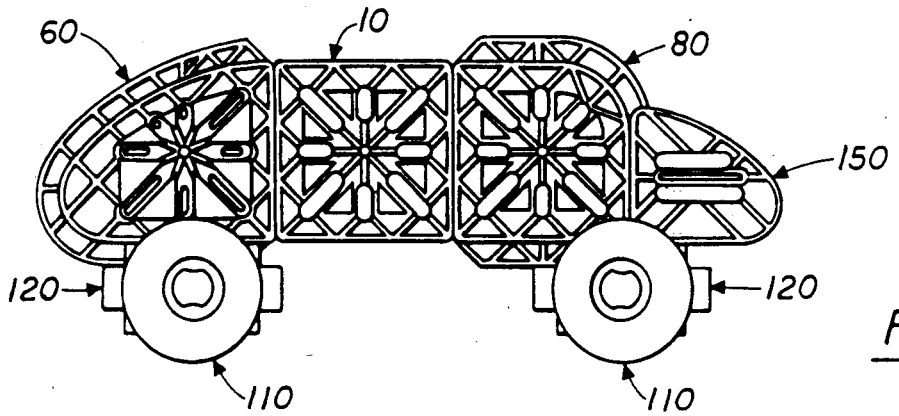
FIG. 47 is a plan view of plurality of blocks oriented and interconnected to simulate a vehicular type of toy.
Figure 48:
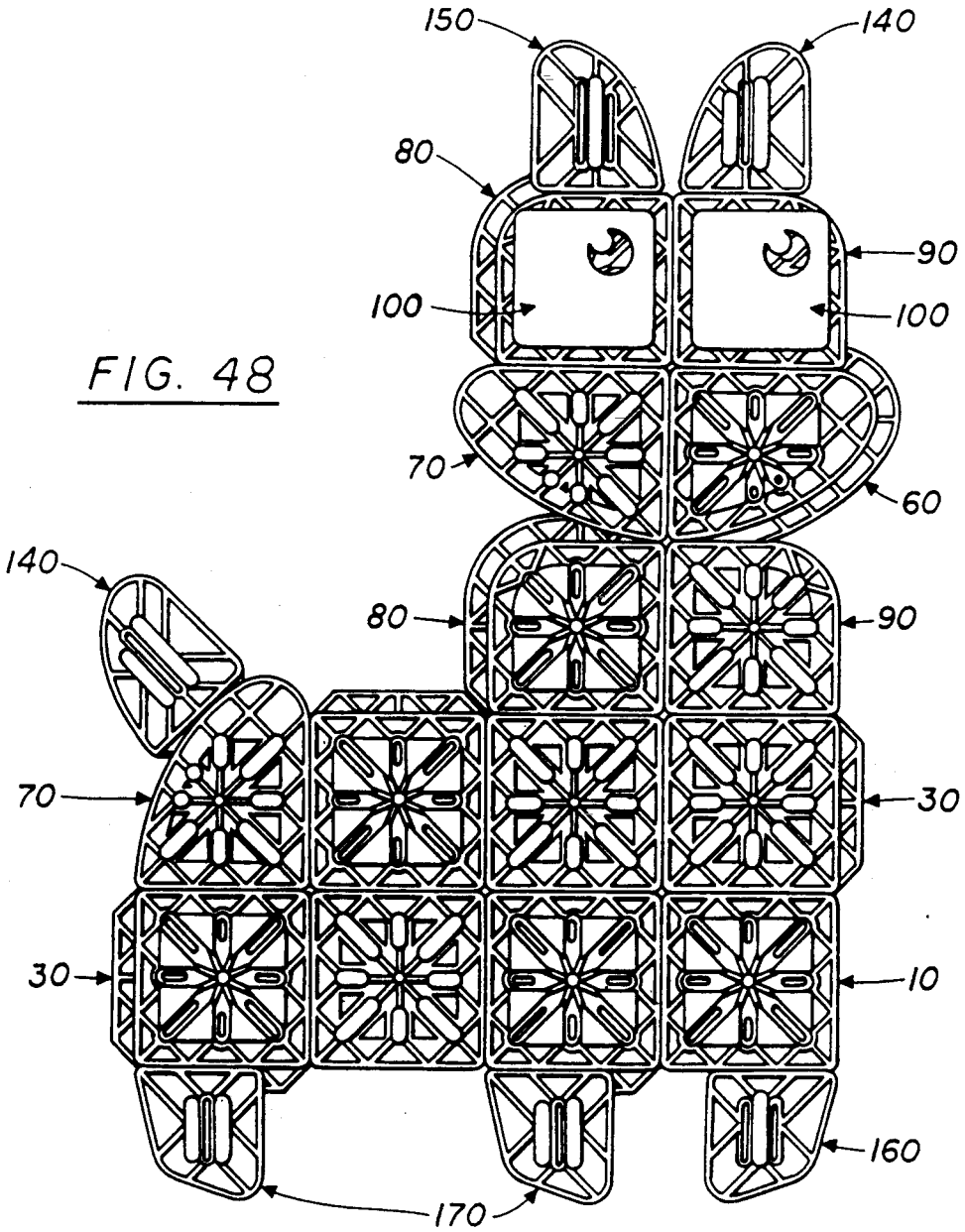
FIG. 48 shows a further assemblage of blocks simulative of a domestic animal.
Figure 49:
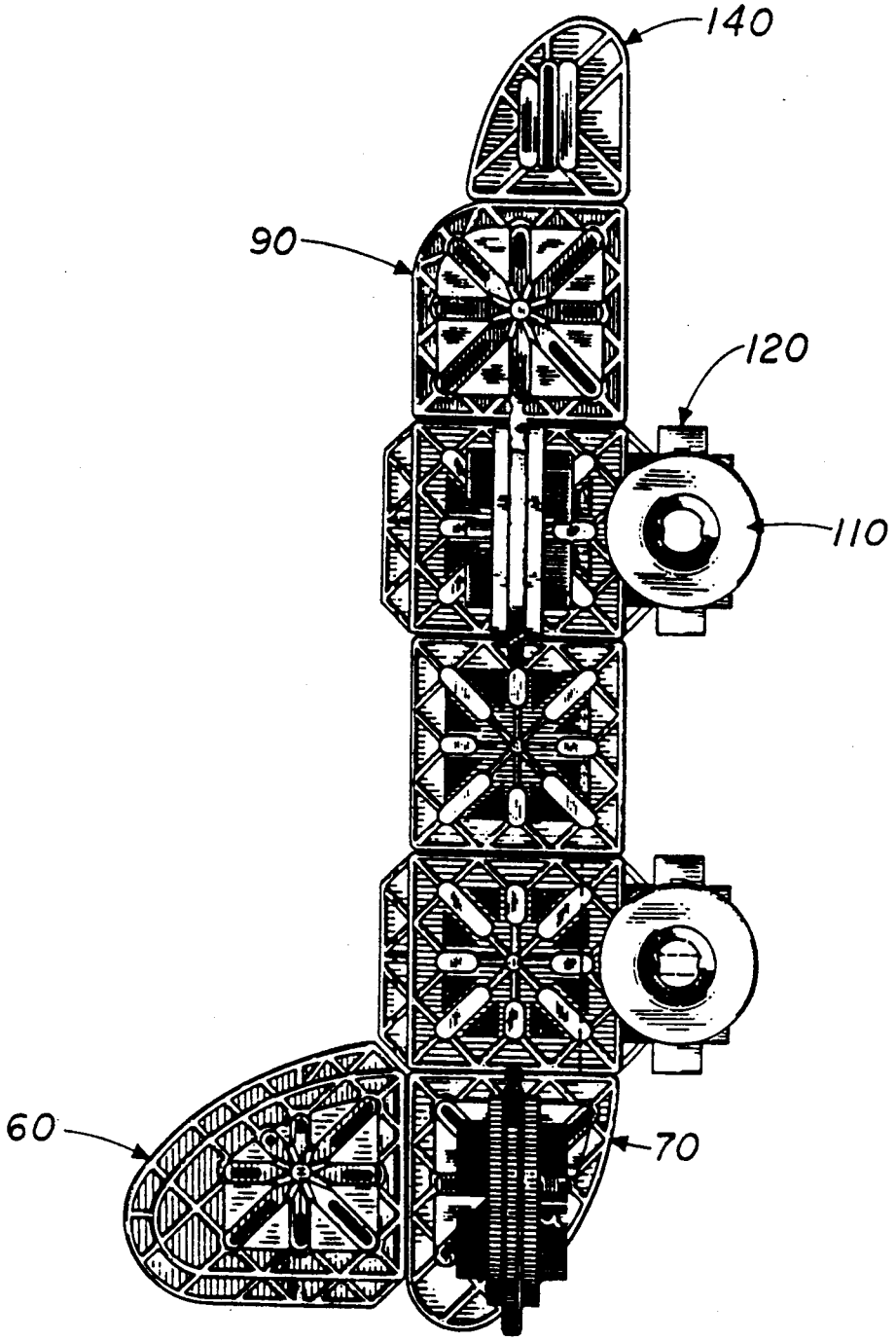
FIG. 49 shows a side view of an airplane.

For example, FIG. 47 depicts a vehicle. FIG. 48 is evocative of a domestic animal. FIG. 49 is a side view of an airplane.

Figure 50:
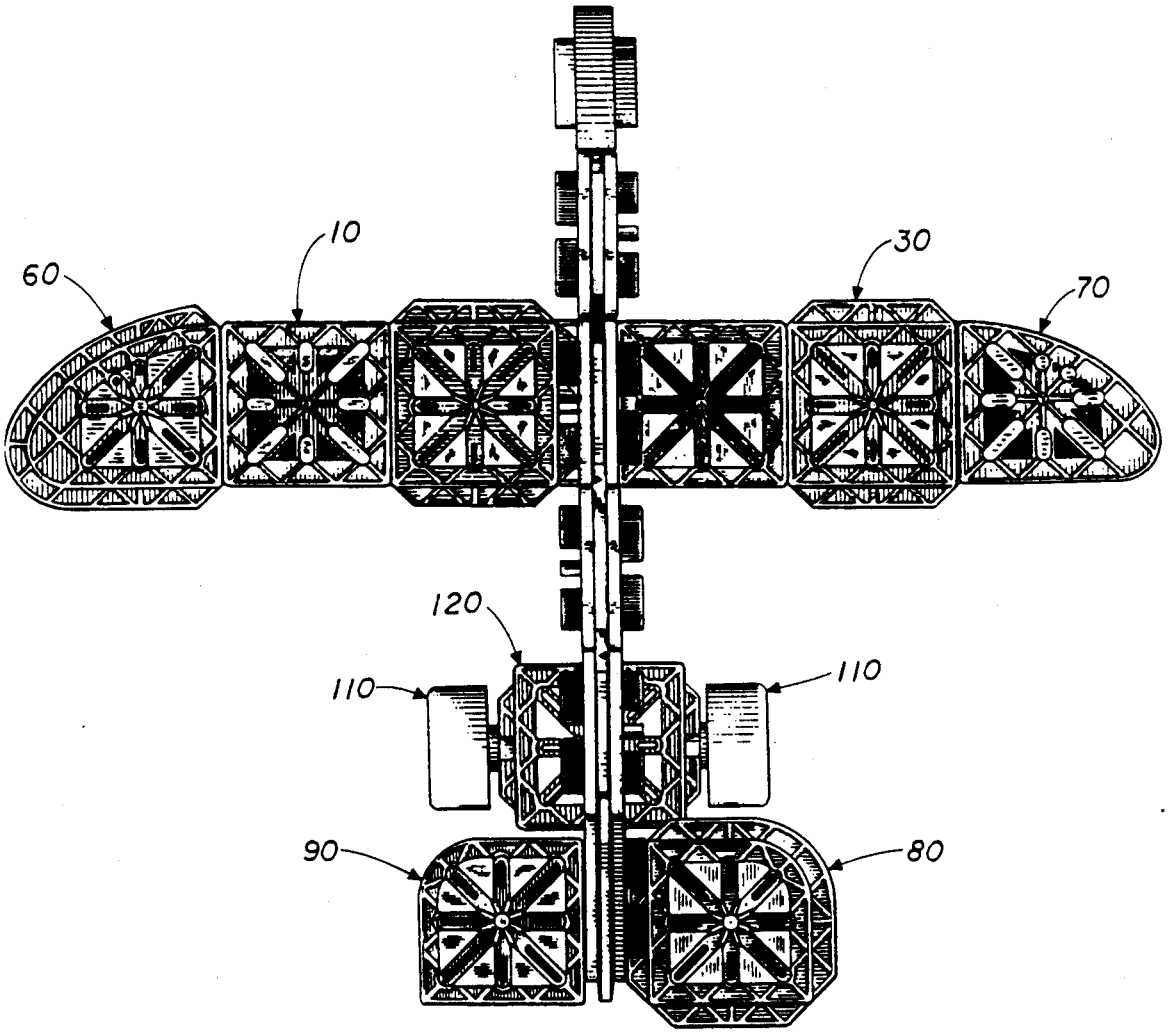
FIG. 50 is a top plan view of FIG. 49.
Figure 51:
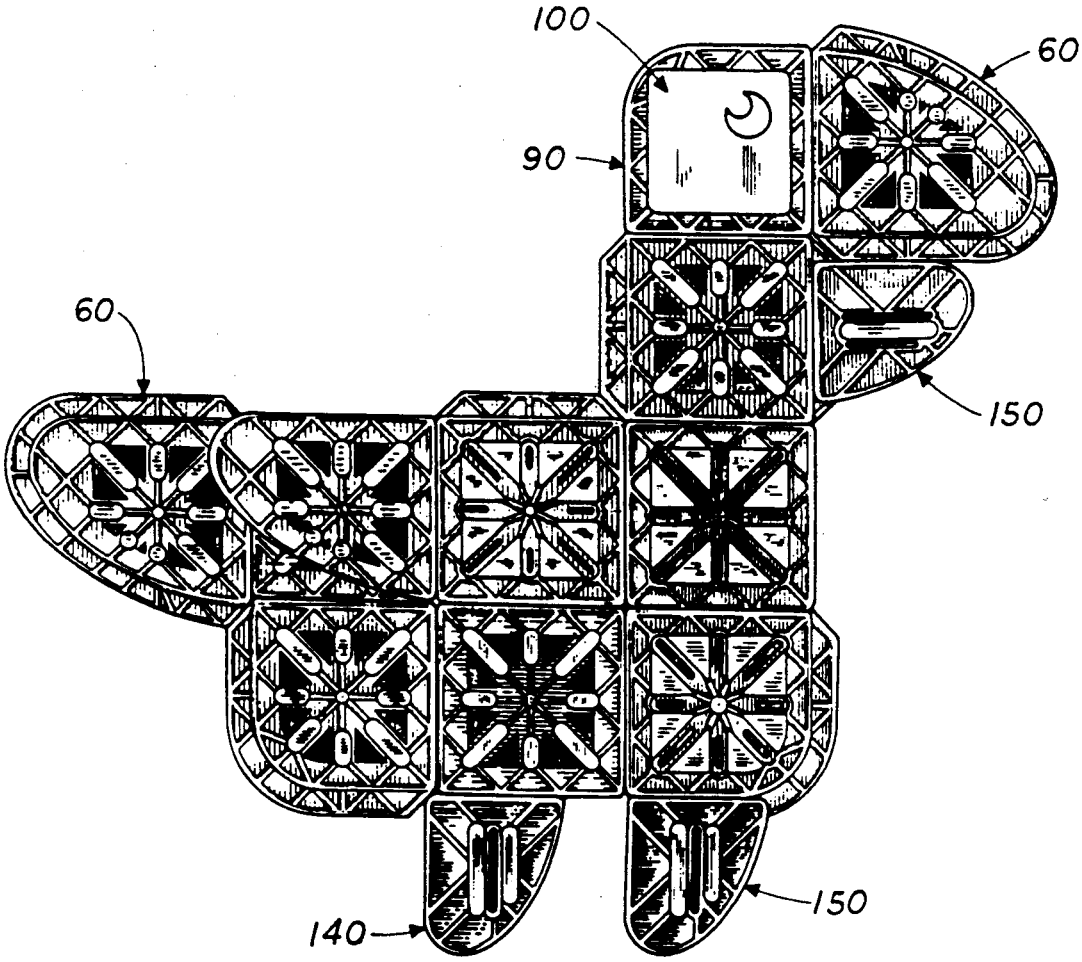
FIG. 51 is a side view of a bird.

FIG. 50 is a top plan view of that which is shown in FIG. 49 and FIG. 51 is evocative of a bird from a side view.

Figure 52:
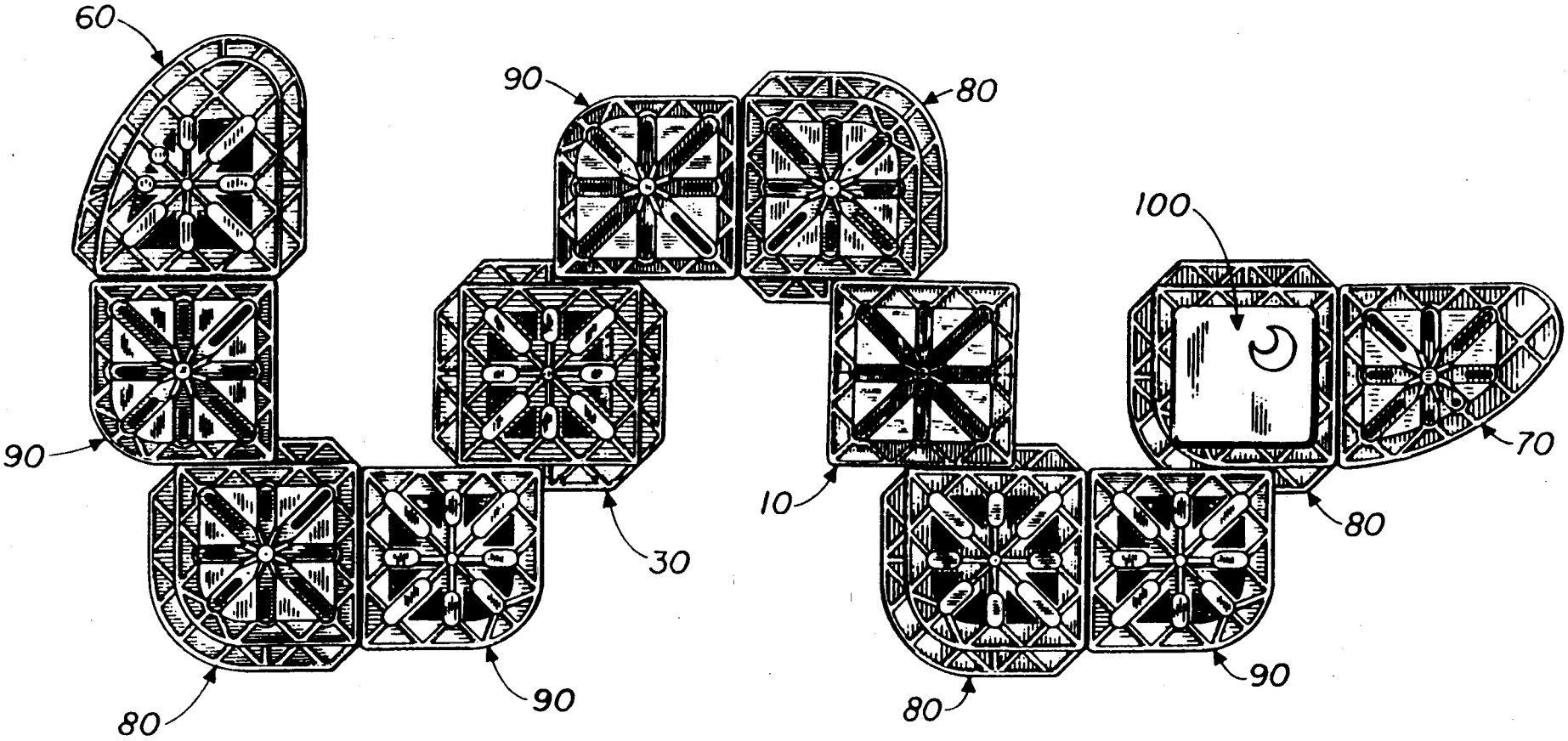
FIG. 52 is a side view of a serpent.

FIG. 52 is a side view of a serpent.

Moreover, having thus described the invention, it should be appreciated that numerous structural modifications and adaptations may be resorted to without departing from the scope and fair meaning of the instant invention, as set forth hereinabove and as defined herein below by the claims.

I claim:

1. A sub-planar building block comprising, in combination a planar top wall, a planar bottom wall and a peripheral edge between said top and bottom wall, said top wall defining a first attachment surface, said bottom wall defining a second attachment surface, said first and second attachment surfaces defining complemental, interconnecting contours, of plural centrally disposed radially extending vanes of constant width centrally disposed on one said wall frictionally engageable within a series of complementally formed spaces on another said wall and said peripheral edge defines a third attachment means.

2. The block of claim 1 wherein said top wall is formed with a plurality of radially extending recesses.

3. The block of claim 2 wherein said bottom wall includes a plurality of radially extending vanes, said vanes having a width complemental to said top wall's recesses for defining said first and second attachment surfaces.

4. The block of claim 3 wherein said third attachment surface is formed with a peripherally extending projection having a thickness complemental to the width of said recess.

5. The block of claim 3 wherein said third attachment surface includes a channel having a thickness complemental to the thickness of said vanes.

6. A wafer-shaped toy, comprising, in combination: a planar top wall including a plurality of uniform width, centrally disposed radially extending vanes, a planar bottom wall including a plurality of uniform width, radially extending recesses dimensioned to frictionally receive said vanes therewithin, and a peripheral edge extending between said top and bottom walls provided with means for linking said edge with another wafer shaped toy engaging either of said vanes or said recesses of said another wafer shaped toy.

7. The toy of claim 6 wherein said wafer-shaped toy is a unitary, integrally molded structure, wherein said vanes on said top wall define said recesses on said bottom wall, thereby assuring mating registry of any of a plurality of blocks formed from a mold cavity.

8. The toy of claim 7 wherein said top wall is substantially polygonal having N sides, and 2N vanes project radially therefrom, said bottom wall therefore including 2N recesses.

9. The toy of claim 8 wherein said peripheral edge of one said wafer is provided with a projection, and a peripheral edge of another said wafer is provided with a complementally formed channel adapted to receive said projection therewithin.

10. The toy of claim 9 wherein said projection has a width complemental to the width of said recess whereby said projection can also connect with said recess as well as said channel.

11. The toy of claim 10 wherein said projection on said peripheral edge is truncated at corners of said N sided polygon.

12. The toy of claim 11 wherein said channel includes a first bead and said projection includes a trough inboard of a peripherally extending flange, which when said trough and flange collectively are inserted within said channel up to said trough and said first bead, a first degree of interconnection, simulative of a hinge having relative motion between said wafers is provided.

13. The toy of claim 12 wherein said projection includes a lip extending inboard from said trough and to said top and bottom walls of said wafer-shaped toy, whereby when said lip is fully inserted within said channel, adjacent toys thusly interconnected are rigidly locked and not as capable of rotation; and a second bead is provided inboard said first bead and on said channel to lock with said trough.

14. A toy construction set formed from plural elements comprising, in combination: a plurality of planar facets defining an exterior of a first said element, means on one of said planar facets for connecting said first element to a second element including a plurality of radially extending vanes of constant width centrally disposed on said first element, said second element having multiple planar facets defining an exterior and provided with at least one planar facet having uniting means complemental to said connecting means to frictionally receive said connecting means, whereby said uniting and connecting means allow said first and second elements to be linked and a peripheral edge on all said elements adapted to connect to said planar facets or another said edge of another said element.

15. The toy construction set of claim 14 wherein said first element includes uniting means.

16. The toy construction set of claim 15 wherein said second element is provided with connecting means.

17. The toy construction set of claim 16 wherein a projection attachment means is provided on said first element.

18. The toy construction set of claim 17 wherein a channel attachment means is provided on said second element.

19. The toy construction set of claim 18 wherein said connecting means is configured as a plurality of radially extending vanes dimensioned to receive both recesses and said channel attachment means.

20. The set of claim 19 wherein said uniting means is configured as a plurality of recesses dimensioned to receive both said vanes and said projection attachment means.

21. The set of claim 20 including accessory block means connectable to other said elements.

22. The set of claim 21 including a carriage supporting an axle and wheels, connectable to said elements.

23. The set of claim 22 including a cover adapted to occlude one of the attachment areas.

* * * * *